United States Patent [19]

Kilgore

[11] 4,276,957

[45] Jul. 7, 1981

[54] PORTABLE SCAFFOLD ASSEMBLY WITH MOVABLE ANCHOR

[76] Inventor: H. Lee Kilgore, 5563 Rattlesnake Hammock Rd., C-11, Naples, Fla. 33942

[21] Appl. No.: 110,508

[22] Filed: Jan. 8, 1980

[51] Int. Cl.[3] ..... E04G 3/08; E04G 3/10

[52] U.S. Cl. ..... 182/130; 182/58; 182/150; 182/206

[58] Field of Search ..... 182/150, 206, 58, 59, 182/130–132; 248/237, 236, 226.4, 235, 243, 244, 245

[56] References Cited

U.S. PATENT DOCUMENTS

| | | | |
|---|---|---|---|
| 623,675 | 4/1899 | Knaust | 182/59 |
| 957,324 | 5/1910 | Gall | 182/150 |
| 2,043,864 | 6/1936 | Novak | 182/58 |
| 2,308,142 | 1/1943 | Alloway | 182/150 |
| 2,854,292 | 9/1958 | Schaeffer | 182/150 |
| 2,988,181 | 6/1961 | Darrey | 182/182 |
| 3,011,587 | 12/1961 | Mallog | 182/150 |
| 3,134,567 | 5/1964 | Shoemaker | 182/150 |
| 3,158,223 | 11/1964 | Brown | 182/150 |
| 3,510,097 | 5/1970 | McCaleb | 182/150 |
| 3,515,244 | 6/1970 | Weible | 182/150 |
| 3,595,510 | 7/1971 | Hutchinson | 248/235 |
| 4,029,173 | 6/1977 | Wakabayashi | 182/150 |
| 4,074,792 | 2/1978 | Zaugg | 182/150 |

FOREIGN PATENT DOCUMENTS

| | | | |
|---|---|---|---|
| 1283852 | 10/1960 | France | 182/150 |

*Primary Examiner*—Reinaldo P. Machado

*Attorney, Agent, or Firm*—David H. Semmes; Warren E. Olsen

[57] ABSTRACT

An improvement in portable scaffold assemblies which enables a scaffold to be securely hung upon a vertical portion of the building, without the need for permanent anchoring means, either on the building or on the scaffolding frame itself. The portable scaffold assembly is preferably constructed of square tubing, with a main pair of open-ended vertically extending tubular members comprising the main structural member for a permanent walkway, and also for hanging an auxillary walkway, therebelow. The scaffold may be positioned, in a vertical sense, very close to the top of the vertical building portion which supports the assembly, or telescoped downwardly therefrom to any desired extent. This is allowed by a pair of L-shaped upper arms which telescopically engage both the main scaffold holder assembly, and also the removable L-shaped anchors, which are movably fitted against the vertical supports of the building structure.

4 Claims, 7 Drawing Figures

PORTABLE SCAFFOLD ASSEMBLY WITH MOVABLE ANCHOR

BACKGROUND OF THE INVENTION

1. Field of the Invention

The invention relates to portable scaffold assemblies, as generally and commonly used in both construction industries, and also in repair industries. The invention particularly relates to a new type of portable scaffold which does not require any protruding permanent mounting member on the building structure itself, due to a novel cooperation between a pair of L-shaped support arms, into removable anchors, which can engage either into a vertical aperture, or a vertical inside of a building structure.

2. Description of the Prior Art

Various and sundry scaffolding constructions are known in the prior art, and to applicant's knowledge the following prior art patents, discovered as part of an investigation of Patent Office records, are considered representative:

| Inventor | U.S. Pat. No. |
|---|---|
| Gall | 957,324 |
| Goodrich | 1,814,688 |
| Alloway | 2,308,142 |
| Danrey | 2,988,181 |
| Mallog | 3,011,587 |
| Shoemaker | 3,134,567 |
| Brown | 3,158,223 |
| McCaleb | 3,510,097 |
| Weible | 3,515,244 |
| Wakabayashi | 4,029,173 |
| Zaugg et al. | 4,074,792 |

Perhaps most pertinent to the teachings taught herein are the prior art approaches in the patents of Shoemaker, at FIG. 6, and the teachings illustrated most simply by the Weibel patent, at FIG. 1. In either case, a generalized scaffold hanger is used with both a vertically movable scaffold and/or an auxillary scaffold attached to the main scaffold. In distinction, the present design structurally departs from a permanent hanger structure, in that a separate L-shaped anchor unit is used, in a removable sense on a building structure, to receive a horizontally disposed square-tube extension of an L-shaped upper arm, which cooperates with the main scaffolding support structure, in a telescoping manner.

The enclosed patents further illustrate various types of inverted "U-shaped" hangers, for example as shown by FIG. 1 of the Weible patent, and also by FIG. 1 of the patent in the name of McCaleb, and FIG. 6 of the patent in the name of Shoemaker. Again, the present invention departs from such structures by having a separate telescopically engageable anchoring member, which completely avoids the need for any permanent protuberance, whatsoever, from outside of the vertical building line.

Accordingly, it is an object of the present invention to provide a portable scaffold assembly which is easily assembled on a job site, and can be used upon any vertically extending portion of the building wall, without need for any permanent anchor assembly, or exact cooperation to any accommodating structure on the building.

A further object of the present invention is to provide a portable scaffold assembly which is also adapted to be engaged into simple vertically drilled holes in a superposed roof structure of a building, to enable the vertical sandwiching support effect which is simply required by the present invention.

Further objects, features and advantages of the present invention will become more apparent from the accompanying detailed description of a preferred embodiment, wherein reference is made to the accompanying drawings.

DESCRIPTION OF THE PREFERRED EMBODIMENT

Figure 1:
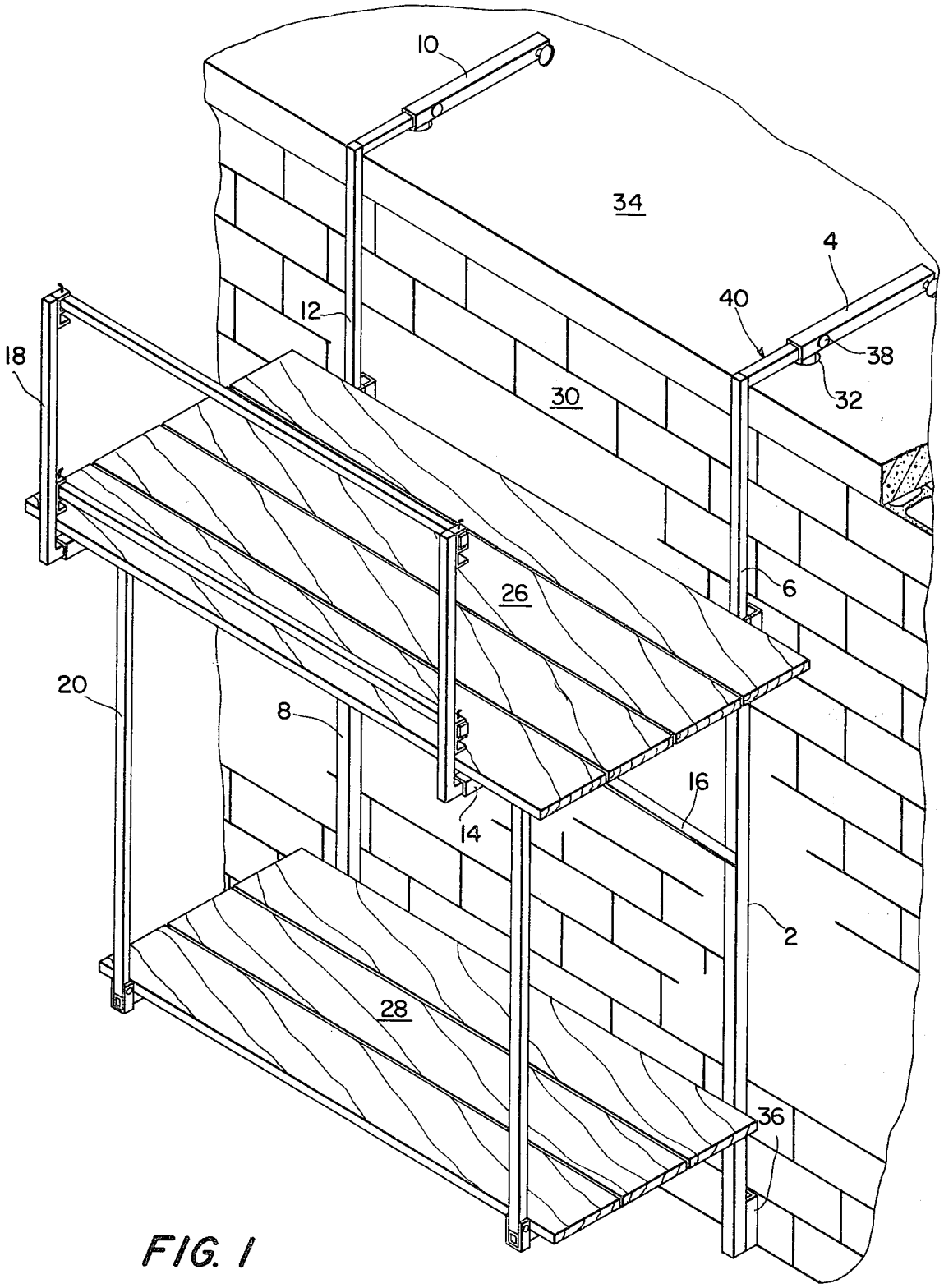
FIG. 1 is a prospective view of a portable scaffold assembly according to a preferred embodiment of the present invention.

With reference to the drawing figures, with common reference numerals being used to designate the same parts in each of the respective views, it can be appreciated that the present invention comprises a portable scaffold assembly which is adapted to be engaged in support upon most any vertically extending building structure. The invention essentially comprises a pair of vertically extending, open-ended tubular members, 2, 8, with each member having rigidly attached thereto a horizontally extending walkway support, 14, for the purpose of supporting a superposed walkway, 26, which may be of water or any other light weight standing material. The assembly further comprises a pair of upper arms, 6, 12, which each are adjustably fitted, at a proximate end, for a telescopic engagement into the upper open ends of said vertically extending tubular members. Each upper arm further includes, at its distal end, a horizontally extending portion, 40, which is adjustably fitted to engage with a horizontally extending, first end portion of an anchor, 4, 10.

Figure 2:
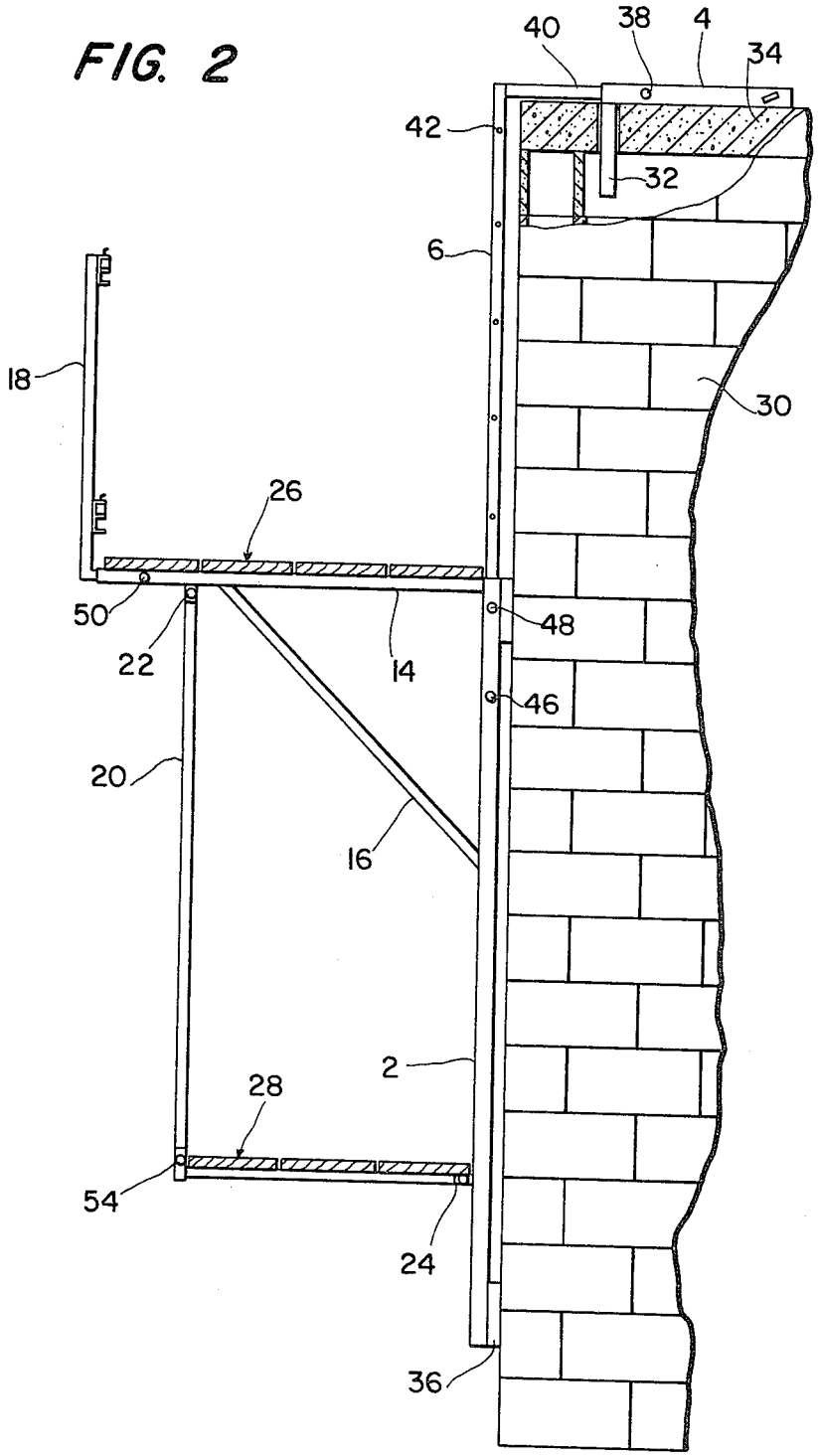
FIG. 2 is a side elevation view thereof, with adjustable components being shown in the relevant position of FIG. 1.

As shown in FIG. 1 the representative anchor, 4, accepts, in a telescopic fashion, the horizontally extending upper portion of the arm, 6, with a rigid fixation being accomplished by the use of a pin locking means, 38. With reference to FIGS. 1 and 2, the scaffold is shown in a relatively lowered position, wherein each upper arm is pinned to accommodate the desired level for each of the two walkways, 26, 28. The second walkway, 28, is considered an auxillary scaffold, and is effectively held by a vertical support member, 20, which extends from pin connection, 22, from the bottom of the upper walkway support, 14. The upper walkway is further braced, 16, to ensure structural integrity. The lower or auxillary walkway, 28, is a separate element which is pinned, at 54, and 24, to the auxillary hanger, 20, and an accepting connection on the main vertical tubular member, 2, as shown most clearly in FIG. 2. The upper walkway includes a railing assembly, 18, which may also be telescopically pinned into square tubing, which comprises the horizontal tubular support, 14, all as shown by the pin means, 50.

Having now described the basic elements which comprise the hanger, attention will now be directed to the manner of telescopically engaging the representative upper arm, 6, around both a building structure, and into the main supporting scaffold member, 2. The Removable anchor, 4, has a vertically extending portion, which is also proximate the first end which accepts the horizontal portion of the upper arm, 40, all for the purpose of enabling an opposed bearing to be accomplished against the vertical portion of the building structure, 30. As shown in FIG. 2, the anchor vertical portion can be inserted into an aperture which is formed within the roof surface, 34, of the building, though the present invention simply requires that a vertical building surface portion be presented, with opposite vertical portions. The bearing comprises a J-shaped interconnection, which is adjustable depending upon the telescoping action of the upper arm, 40, within the anchor, 4, with this desired position being fixed by a pin, as shown at 38.

Figure 3:
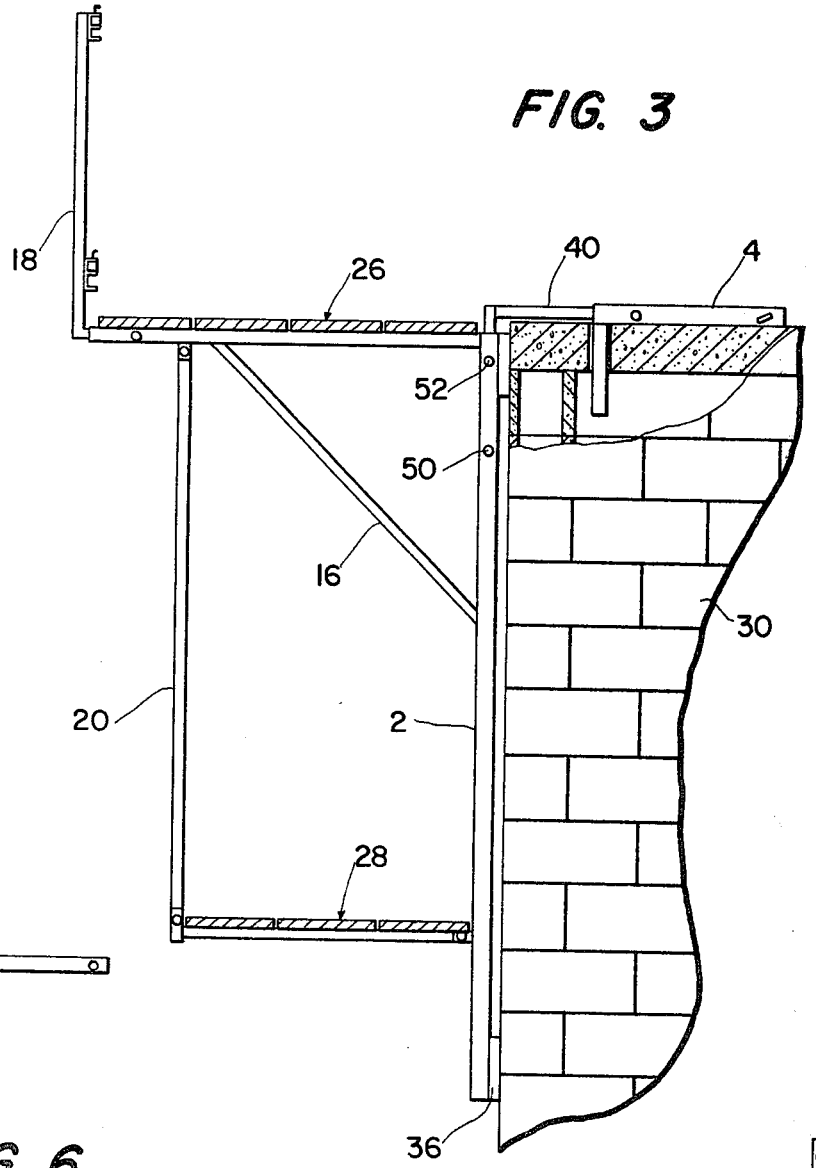
FIG. 3 is a second side elevation view of a preferred embodiment with the scaffold assembly being shown in a relatively raised position.
Figure 6:
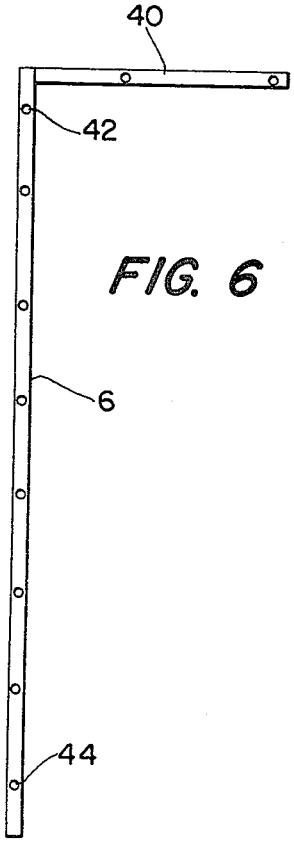
FIG. 6 is a vertical detail view of each of a representative upper arm according to the teaching of the present invention.
Figure 4:
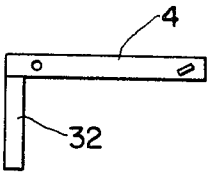
FIG. 4 and FIG. 5 are side and bottom views of the removable anchor taught according to the present invention.
Figure 5:
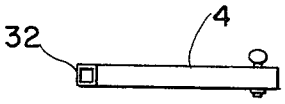

To further appreciate the adaptability of the present invention reference should be had now to FIG. 3, for a contrast between a raised position which is alternative to that of FIG. 2. It can be readily appreciated that the scaffold upper walkway surface, 26, can be placed at an elevation which is virtually at the same altitude as the upper surface of the building, since the upper arms are substantially L-shaped members, which do not require any great clearance to accommodate vertical movement of each main vertical tubular support member, 2. FIG. 6 further illustrates that each of the upper arms can have multiple apertures, 42, 44, with a selective telescopic engagement being simply accomplished by pinning through one or more of these apertures, and into the main support member, 2. The horizontal extending member, 40, is also shown to have two disposed apertures, though of course more may be accommodated if desired. FIGS. 4 and 5 illustrate, respectively, side and bottom views of a representative anchor, which is a critical element of the present invention. The anchors are separate and removable from both the scaffold assembly and the building structure, thereby enabling the scaffold assembly to be used on any building structure, which has a vertical portion with two opposed sides.

The main scaffold vertical members are easily pinned, as at 50, 52, and even to a very high relative position, as shown in FIG. 3, without interferring with any necessary limitation imposed by the anchor or telescoping arm assembly. The main scaffold assembly is maintained against the outer wall by pads, 36, to prevent undue frictional contact between the scaffold and the building, and/or any marring of the surface while telescoping action is being changed.

Figure 7:
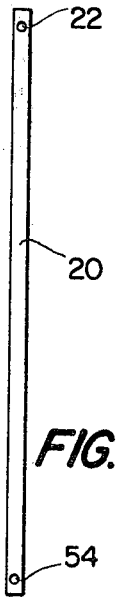
FIG. 7 is a detail view of an auxillary scaffold hanger support, useful with the present invention.

FIG. 7 illustrates that the auxillary scaffold holder is a simple bar member, with pin connections possible at the two ends, 22, 54, and it should also be apparent that this suspending auxillary scaffold member may also be used for supporting other members, in addition to the separable walkway assembly, 28.

In summary, the present invention enables a scaffold to be applied either through a simple aperture in the top surface of a building, or also to be suspended upon the two opposing surfaces of a conventional brick masonry wall, for example. The bearing surface of the scaffold comprises a multiple contact between the bottom surface of the upper arm, 40, as well as a mutual vertical opposite contact between the scaffold, and the inward facing surface of the vertically extending portion of each removable anchor assembly. While various features and advantages of the present invention have been particularly disclosed with respect to this preferred embodiment, it is to be understood that I intend my invention to be limited by the scope of the appended claims.

I claim:

1. A portable scaffold assembly adapted to be engaged and supported upon a vertically extending portion of a building structure, said scaffold assembly comprising a pair of vertically extending, open-ended tubular members, each member having at least one horizontally extending walkway support for supporting a superposed walkway thereon, an upper arm which is adjustably fitted, at a proximate end, for a telescopic engagement within said tubular member, said each upper arm further comprising, at its distal end, a horizontally extending portion which is adjustably fitted to enter a first end and engage within a horizontally extending, open-ended tubular member which extends horizontally to a second end and comprises an anchor said anchor further comprising a vertically extending portion proximate said first end, and adapted to be adjustably and removably fit against a vertically extending first portion of a building structure, whereby each of said vertically extending scaffold tubular members will thereby engage the opposite side of said vertically extending structure portion.

2. A portable scaffold assembly according to claim 1 further comprising an auxillary scaffold hanger assembly which is suspended below said walkway through a first vertically extending member which is hung from at least one horizontally extending walkway support, with a walkway being supported, by the bottom end of said hanging support, and a horizontal member which extends over to a connection with a portion of each of said vertically extending tubular members.

3. A portable scaffold assembly according to claim 1 wherein further said vertically extending tubular member comprises a steel tubing of square cross-section, and the telescoping adjustable fit of said each arm in each of said anchors and vertically extending tubular members further comprises pins which engage corresponding apertures in each of said anchors, upper arms, and vertical extending tubular members.

4. A portable scaffold assembly according to claim 1 wherein each of said upper arms further comprises a square tubing which fits within accepting square tubing comprising each of said anchor and vertically extending tubular members, wherein further the horizontal and vertically extending portions of each upper arm meet at a substantial right angle, so that the cooperation among said each tubular member, said each upper arm and said each anchor further comprises a J-shaped engagement with both vertical opposite sides of a building structure, and also a top portion of the building structure which is between the vertically extending portion of said anchor, and the vertically extending portion of said upper arm.

* * * * *